US009447645B2

(12) United States Patent
Dobush

(10) Patent No.: US 9,447,645 B2
(45) Date of Patent: Sep. 20, 2016

(54) BREAKOUT WRENCH ASSEMBLIES AND METHODS

(71) Applicant: Black Dog Industries LLC, Richland, WA (US)

(72) Inventor: Robert Dobush, West Richland, WA (US)

(73) Assignee: Black Dog Industries LLC, Richland, WA (US)

( * ) Notice: Subject to any disclaimer, the term of this patent is extended or adjusted under 35 U.S.C. 154(b) by 465 days.

(21) Appl. No.: 13/834,558

(22) Filed: Mar. 15, 2013

(65) Prior Publication Data

US 2013/0255965 A1 Oct. 3, 2013

Related U.S. Application Data

(60) Provisional application No. 61/617,332, filed on Mar. 29, 2012.

(51) Int. Cl.
*E21B 19/16* (2006.01)

(52) U.S. Cl.
CPC ..... *E21B 19/163* (2013.01)

(58) Field of Classification Search
CPC ..... E21B 19/163; E21B 19/165; E21B 19/18
See application file for complete search history.

(56) References Cited

U.S. PATENT DOCUMENTS 1,572,986 A * 2/1926 Brewster ..... E21B 19/161 81/55
2,450,934 A 10/1948 Calhoun
2,453,369 A 11/1948 Grable et al.
2,760,392 A * 8/1956 Paget ..... E21B 19/163 81/57.16
3,799,009 A 3/1974 Guier
3,921,473 A 11/1975 Boyadjieff et al.
4,082,017 A 4/1978 Eckel
4,567,952 A 2/1986 Lemaire et al.
4,574,664 A 3/1986 Curry
4,696,206 A 9/1987 Renfro
4,727,781 A * 3/1988 Yuehui ..... E21B 19/163 81/57.19
4,732,061 A * 3/1988 Dinsdale ..... 81/57.34
4,843,945 A 7/1989 Dinsdale (Continued)

FOREIGN PATENT DOCUMENTS

CA WO 2008022424 A1 * 2/2008 ..... E21B 19/163
GB 2063746 A 6/1981

(Continued)

*Primary Examiner* — Jennifer H Gay
(74) *Attorney, Agent, or Firm* — Wells St. John P.S.

(57) ABSTRACT

Break out wrench assemblies are provided that can include: a first subassembly, the first subassembly including a first pair of opposing arms linked by a first actuator configured to extend or compress a distance between the first pair of opposing arms; a second subassembly aligned with the first subassembly to receive a longitudinal member there between and rotate axially along the longitudinal member in relation to the first subassembly, the second subassembly including a second pair of opposing arms linked by a second actuator configured to extend or compress another distance between the second pair of opposing arms; at least one axial actuator coupled to the second subassembly and configured to rotate the second subassembly axially in relation to the first subassembly along the longitudinal member; and a controller coupled to the actuators and mechanically coupled to at least one of the subassemblies. Methods for separating linked longitudinal sections are also provided.

3 Claims, 13 Drawing Sheets

(56) References Cited

U.S. PATENT DOCUMENTS

| | | | | |
|---|---|---|---|---|
| 5,060,542 | A | 10/1991 | Hauk | |
| 5,161,438 | A | 11/1992 | Pietras | |
| 5,174,175 | A * | 12/1992 | Bouligny | 81/57.33 |
| 5,845,549 | A | 12/1998 | Bouligny | |
| 6,212,976 | B1 * | 4/2001 | Stogner | 81/57.34 |
| 6,752,044 | B2 | 6/2004 | Hawkins | |
| 6,776,070 | B1 | 8/2004 | Mason et al. | |
| 7,062,991 | B1 * | 6/2006 | West | E21B 19/18 81/57.16 |
| 7,188,547 | B1 | 3/2007 | West et al. | |
| 7,685,910 | B2 * | 3/2010 | Kennedy | 81/57.16 |
| 7,997,167 | B2 | 8/2011 | Kruse et al. | |
| 8,042,432 | B2 * | 10/2011 | Hunter | E21B 19/163 81/57.16 |
| 8,899,133 | B1 * | 12/2014 | Somerville | 81/57.34 |
| 2003/0132030 | A1 | 7/2003 | Tompkins | |
| 2004/0195555 | A1 * | 10/2004 | Bangert et al. | 254/418 |
| 2005/0076744 | A1 | 4/2005 | Pietras et al. | |
| 2005/0096846 | A1 * | 5/2005 | Koithan et al. | 702/6 |
| 2007/0068669 | A1 * | 3/2007 | Lesko | E21B 19/163 166/77.51 |
| 2008/0011470 | A1 * | 1/2008 | Hobgood | 166/77.1 |
| 2009/0056931 | A1 * | 3/2009 | Kruse et al. | 166/77.51 |
| 2009/0211405 | A1 * | 8/2009 | Hunter | E21B 19/165 81/57.16 |
| 2009/0229422 | A1 * | 9/2009 | Kennedy | 81/57.2 |
| 2011/0030970 | A1 | 2/2011 | Tweedie et al. | |
| 2012/0210828 | A1 * | 8/2012 | Bangert | 81/57.34 |
| 2013/0255965 | A1 * | 10/2013 | Dobush | 166/377 |
| 2013/0305884 | A1 * | 11/2013 | Dobush | E21B 19/168 81/57.33 |
| 2015/0107850 | A1 * | 4/2015 | Mosing et al. | 166/377 |

FOREIGN PATENT DOCUMENTS

| | | |
|---|---|---|
| GB | 2414207 A | 11/2005 |
| WO | WO 00/66875 | 11/2000 |
| WO | WO 2010/092237 | 8/2010 |

* cited by examiner

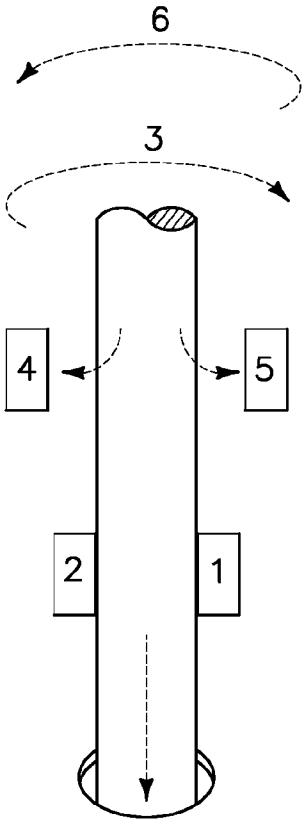
FIG. 12E
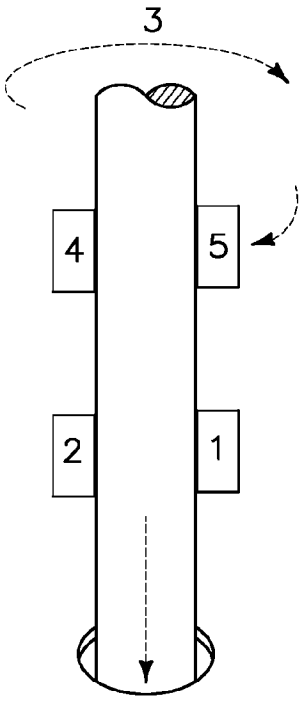
FIG. 12F
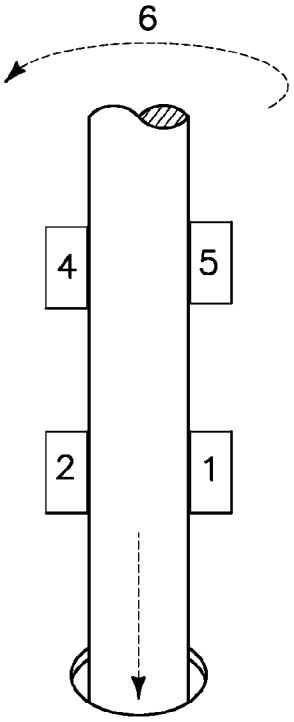
FIG. 12G
FIG. 12H

BREAKOUT WRENCH ASSEMBLIES AND METHODS

CROSS REFERENCE TO RELATED APPLICATION

This application claims priority to U.S. Provisional Patent Application Ser. No. 61/617,332 which was filed on Mar. 29, 2012, the entirety of which is incorporated by reference herein.

TECHNICAL FIELD

The present disclosure relates to the field of well drilling and well maintenance activities that utilize multiple pipe components that are linked together by some type of threaded connection. In particular embodiments, the present disclosure relates to breakout wrenches that may be utilized to break apart these pipe components.

BACKGROUND

In the field of well drilling, oil, gas, or water well drilling, it is becoming a necessity to drill wells deeper than ever before. As a result, more power is needed to rotate the multiple lengths of drill pipe that are utilized to reach these depths during well drilling. These lengths of pipe are connected to one another via a threaded fitting. Upon removing the pipe from the well, it is necessary to break the pipe components or lengths apart at the well head. This can be an extraordinarily dangerous action, as it requires operators to exert a tremendous amount of force in a sometimes unsafe manner to break apart these components. The present disclosure provides breakout wrench assemblies and methods that can be utilized to assist operators in breaking apart pipe components safely, as well as torquing them up to proper specifications.

SUMMARY OF THE DISCLOSURE

Break out wrench assemblies are provided that can include: a first subassembly, the first subassembly including a first pair of opposing arms linked by a first actuator configured to extend or compress a distance between the first pair of opposing arms; a second subassembly aligned with the first subassembly to receive a longitudinal member there between and rotate axially along the longitudinal member in relation to the first subassembly, the second subassembly including a second pair of opposing arms linked by a second actuator configured to extend or compress another distance between the second pair of opposing arms; at least one axial actuator coupled to the second subassembly and configured to rotate the second subassembly axially in relation to the first subassembly along the longitudinal member; and a controller coupled to the actuators and mechanically coupled to at least one of the subassemblies. Break out wrench assemblies can also include: a first subassembly coupled to a second subassembly via an arcuate rail, the second subassembly being rotatable along the rail in relation to the second subassembly.

Methods for separating linked longidutinal sections are provided with at least some of the methods including: providing at least two linked longitudinal sections; with a controller mechanically linked to a break out wrench assembly, actuating a first pair of opposing arms to secure at least one of the sections; with the same controller, actuating a second pair of opposing arms to secure at least another section; and with the same controller, actuating a rotation of the second pair of opposing arms in relation to the first pair of opposing arms to separate the one section from the other section.

BRIEF DESCRIPTION OF THE DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
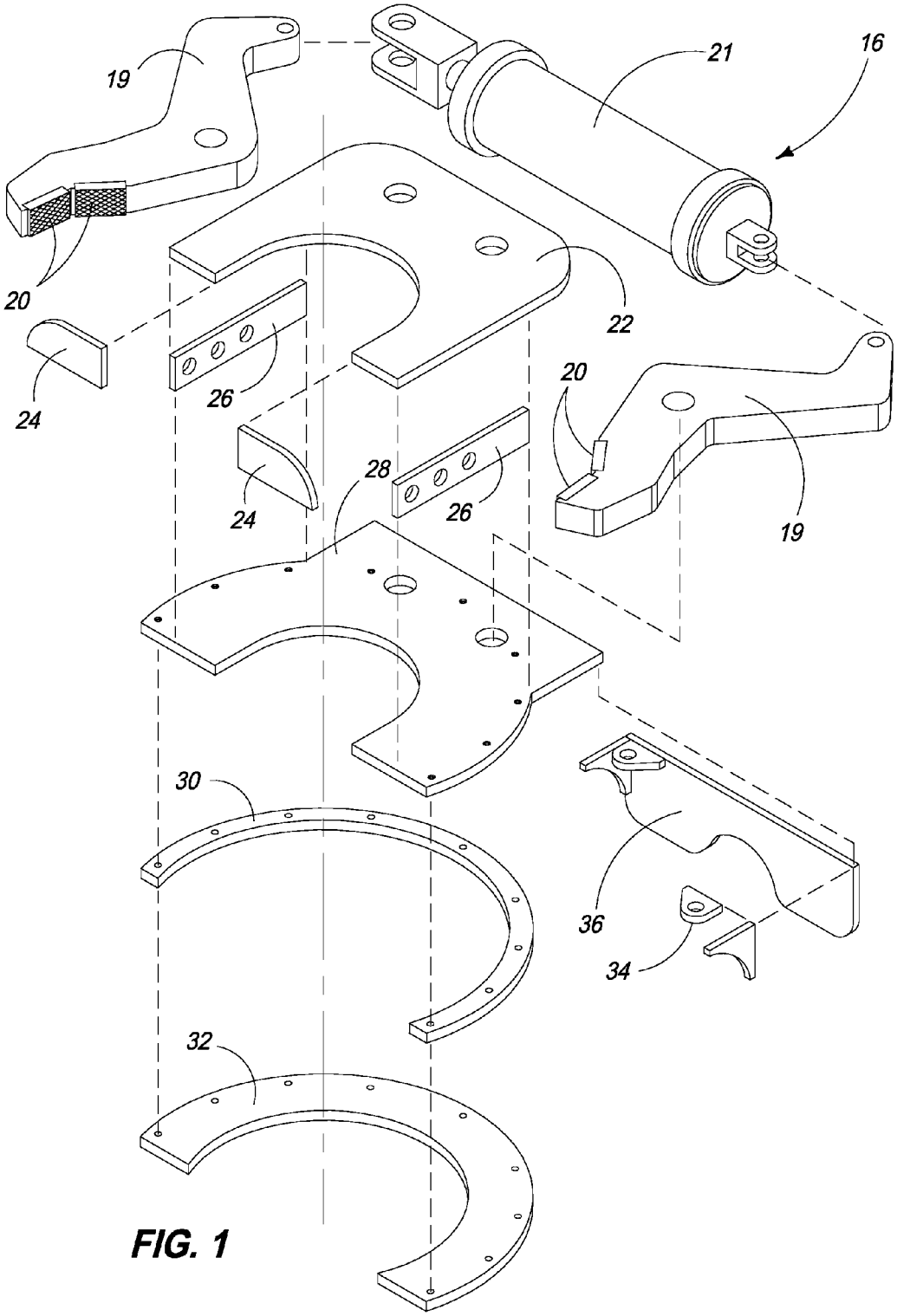
FIG. 1 is an exploded view of one subassembly of a breakout wrench according to an embodiment.

The present disclosure will be described with reference to FIGS. 1-12B. Referring first to FIG. 1, a subassembly 16 of breakout wrench assembly 12 (shown in FIG. 11) is depicted. As can be seen, this subassembly includes an actuator 21 that can be coupled to opposing arms 19 having teeth 20. Upper plate 22 and side walls 26 and 24 as well as bottom plate 28 can form a housing that encloses arms 19 and provides pivot rotation for arms 19 within this housing. This housing can be engaged to a rail 30 which is mounted to a rotation plate 32 to form recess 31 (FIG. 3). Recess 31 can form a track configured to receive rail 46. Below actuator 21 can be a pivot housing that includes back plate 34 as well as eyelets 36 and 38 respectively. Actuators can include hydraulic cylinders.

Figure 2:
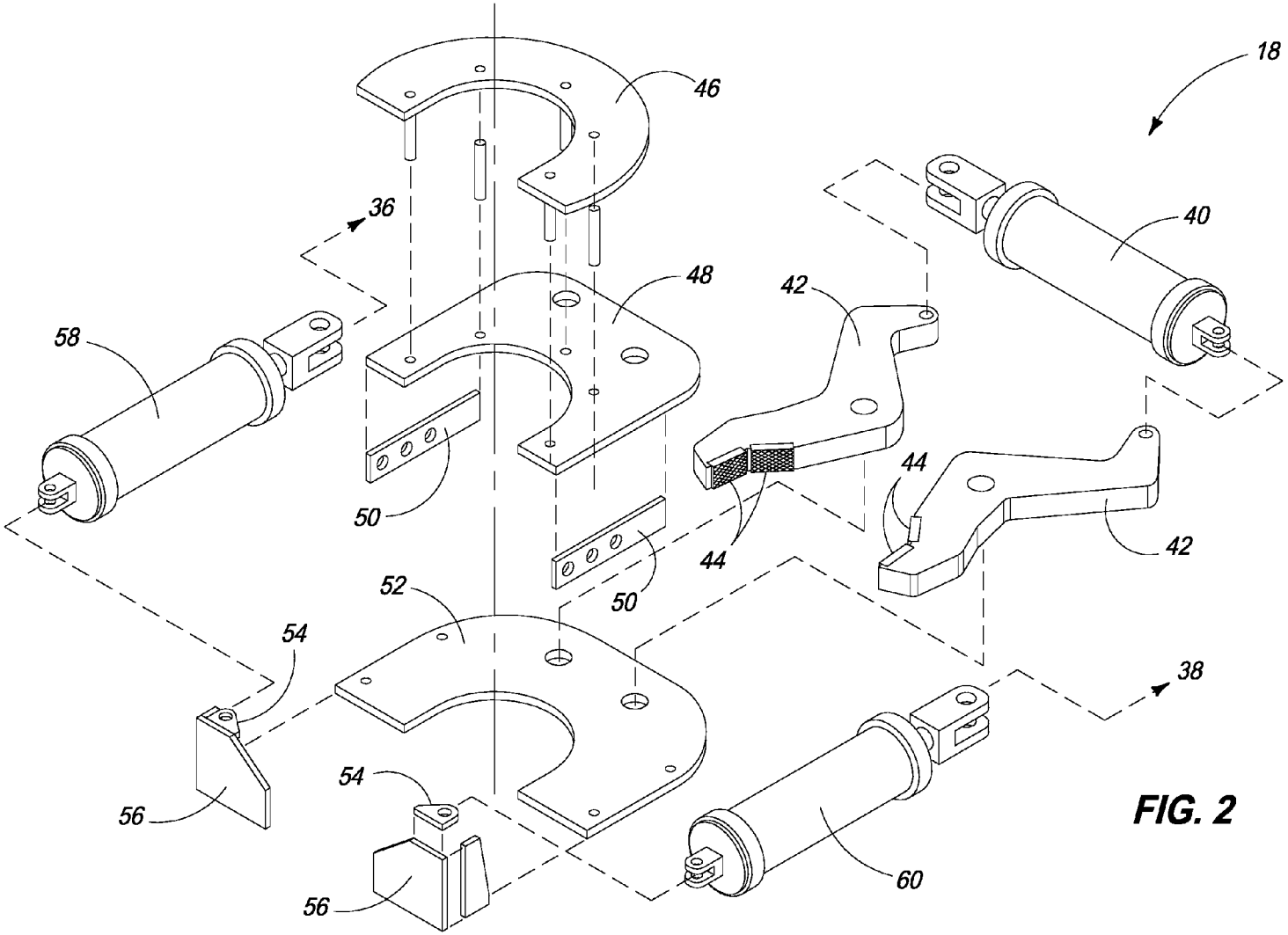
FIG. 2 is an exploded view of another subassembly of a breakout wrench according to an embodiment.
Figure 3:
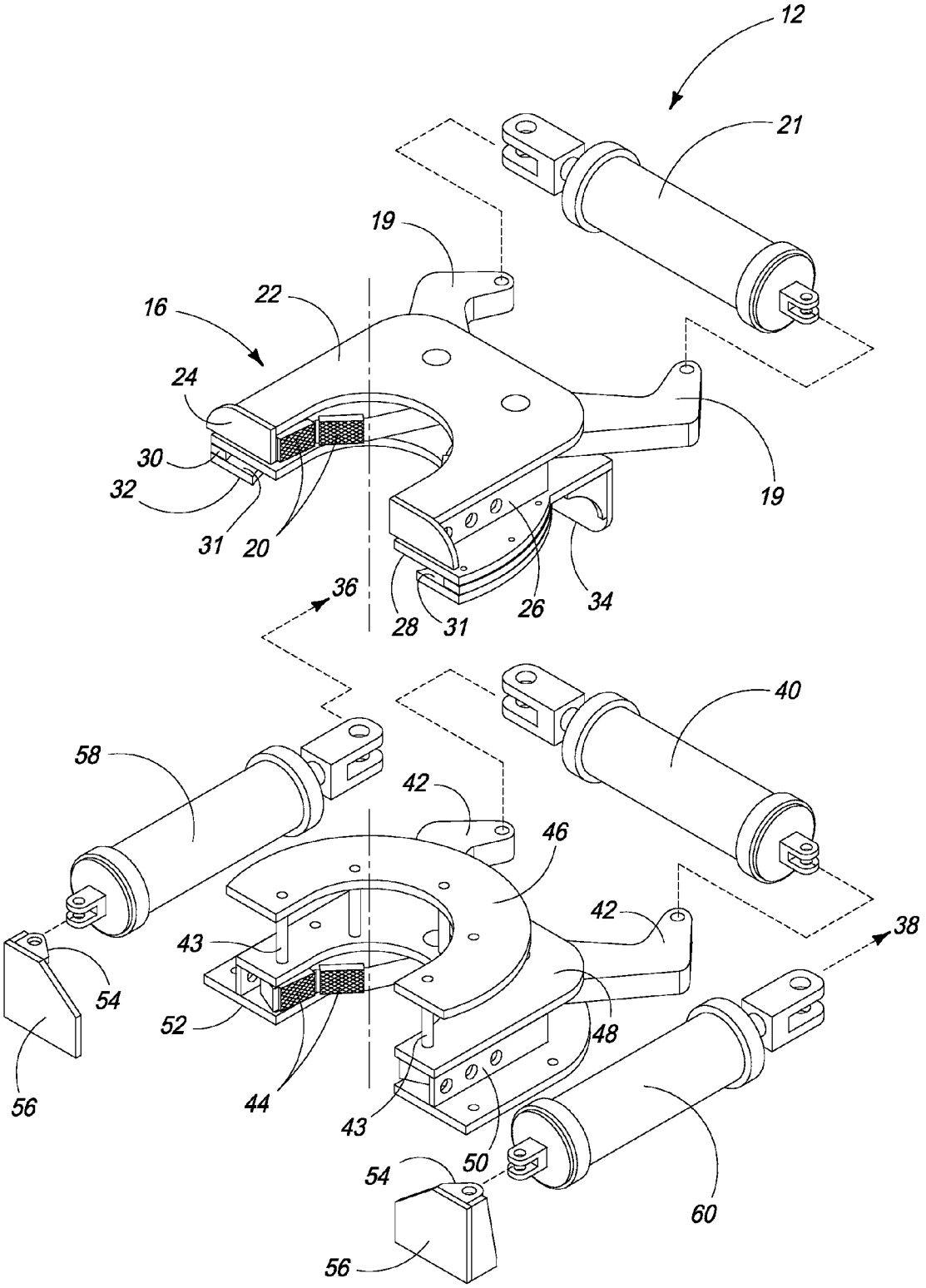
FIG. 3 is an exploded view of the two subassemblies of FIG. 1 and FIG. 2 according to an embodiment.

Referring to FIG. 2, another subassembly 18 is shown that includes an actuator 40 coupled to opposing arms 42 having teeth 44 associated therewith. Upper plate 48 as well as side walls 50 and front walls 56 and bottom plate 52 can form a housing that encloses arms 42 and engages them in a pivotable rotation therewith. Above upper plate 48 of subassembly 18 can be rail 46 which is engaged to couple with recess 31. At opposing sides of subassembly 12 can be one or more actuators 58 and 60, respectively. Acutator 58 can pivotably couple with eyelet 54 as shown and actuator 60 can couple with opposing eyelet 54. These actuators cylinders can have opposing ends, and one opposing end can be configured to couple to eyelet 36 as shown in FIG. 1. Actuator 60 can be configured to couple with eyelet 38 as shown in FIG. 1 as well.

Referring to FIG. 3, the subassemblies are shown in a subset exploded view associated with one another as subassembly 16 is shown associated with subassembly 18. Posts 43 can support the second subassembly above the first subassembly via rail 46 and recess 31.

Figure 4:
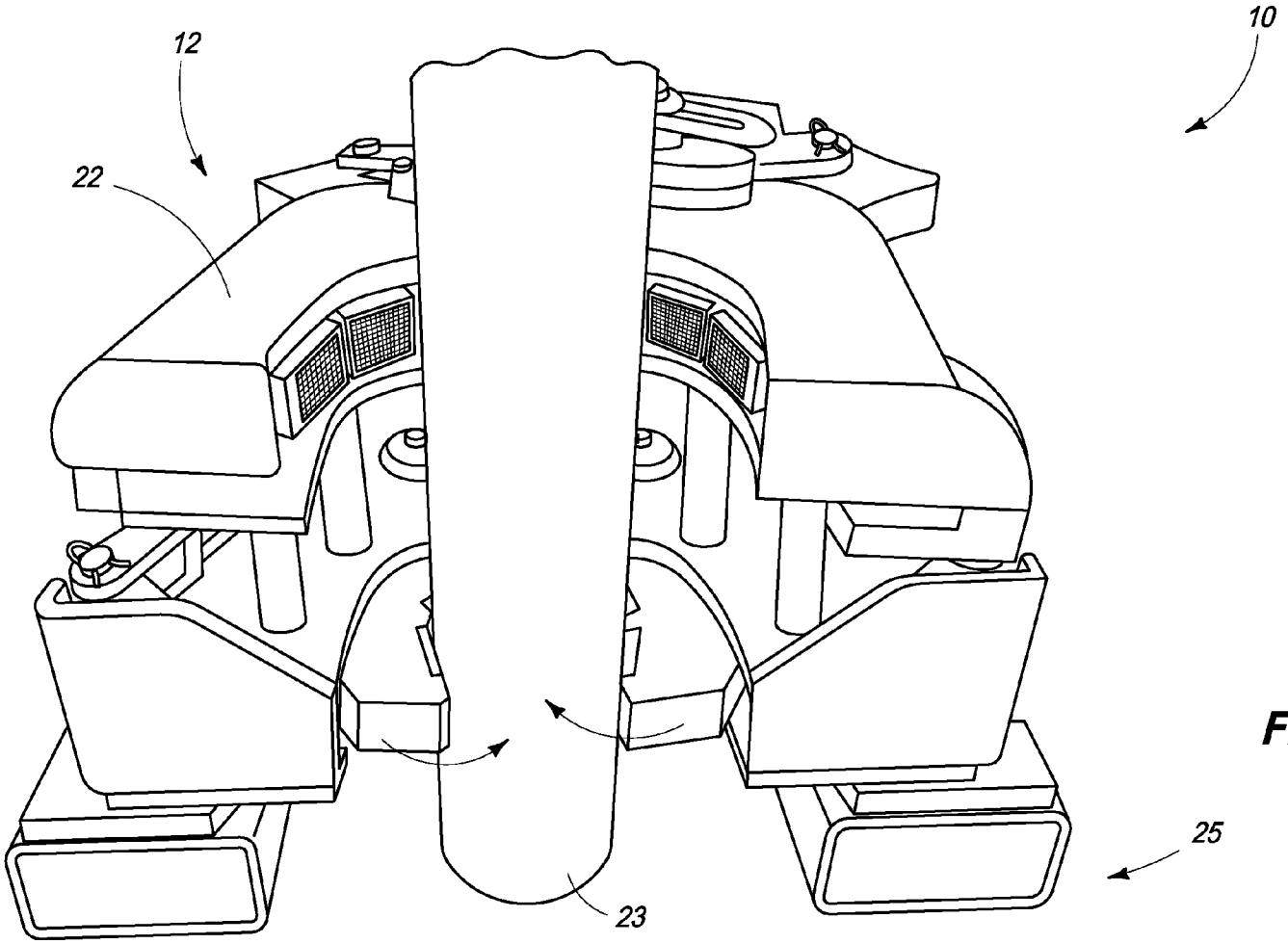
FIG. 4 is a breakout wrench at one stage of operation according to an embodiment.
Figure 5:
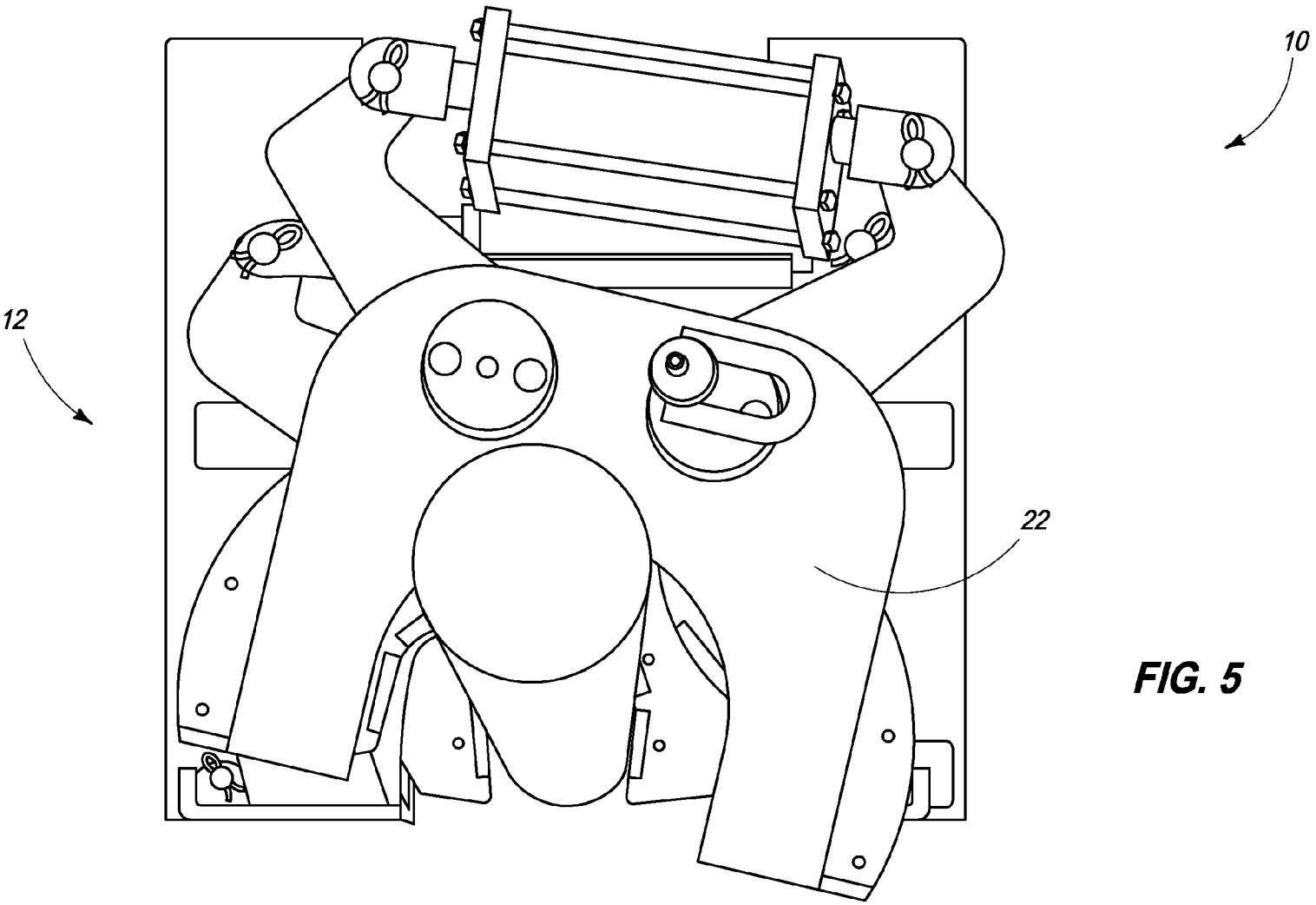
FIG. 5 is a breakout wrench at another stage of operation according to an embodiment.

Referring to FIG. 4, operation of the wrench can include configuring the wrench to couple with a pipe 23 as shown in FIG. 5. Pipe 23 can be at least a pair of longitudinal sections configured to releasably couple. Examples include sections of drilling pipe. As can be seen, wrench 10 is in an operable position 25 proximate pipe 23 rather than another position away from pipe 23. According to this stage of operation, the assembly 18 would engage the arms to engage a section of pipe. Referring to FIG. 5, a top view of this engagement is shown with the upper assembly rotated at least slightly askew from the lower assembly.

Figure 6:
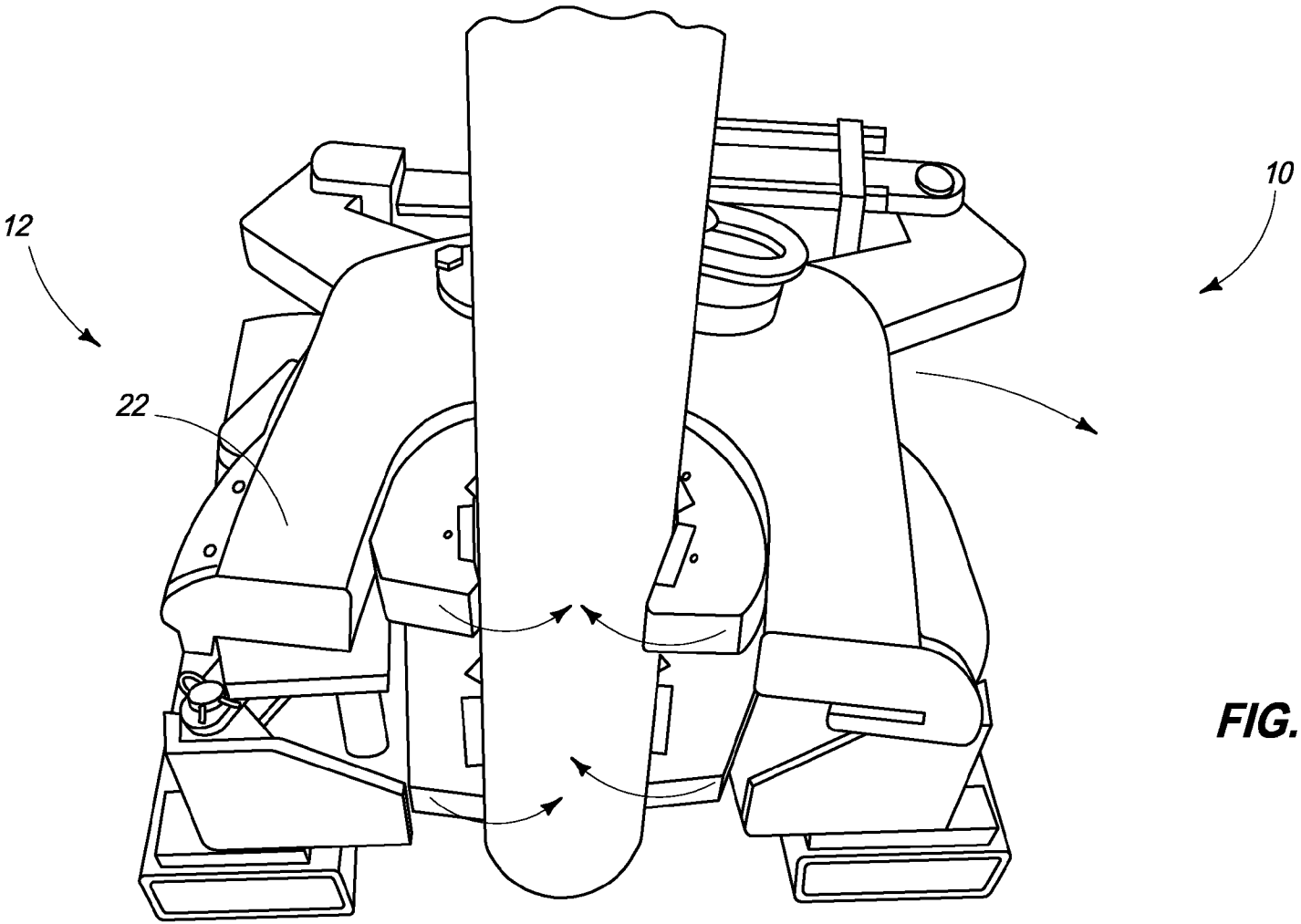
FIG. 6 is a breakout wrench at another stage of operation according to an embodiment.
Figure 7:
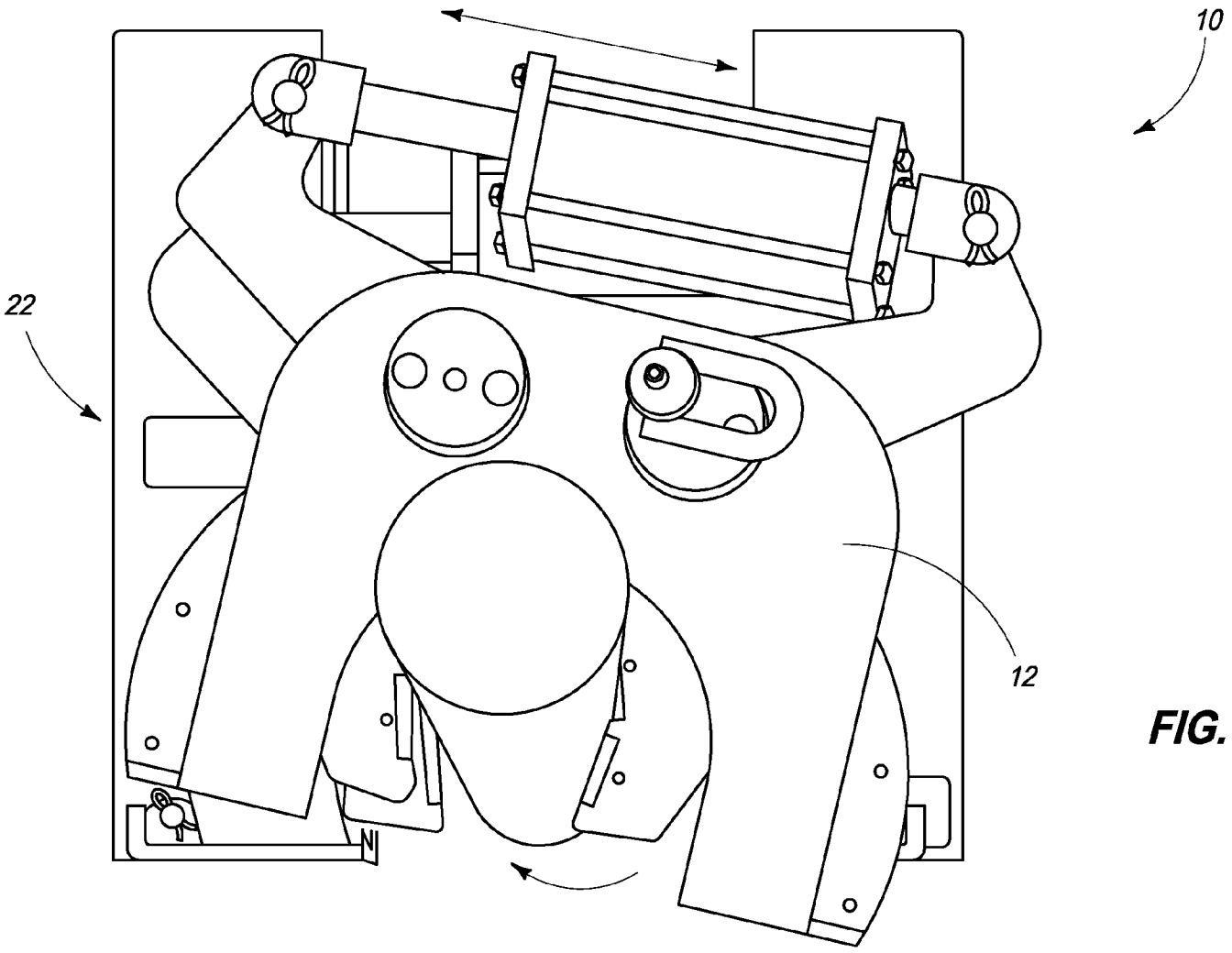
FIG. 7 is a breakout wrench at another state of operation according to an embodiment.

Referring to FIG. 6, at this stage, both the upper and lower arms of the assembly would engage the pipe with the upper assembly askew to the lower assembly, engaging an upper length of pipe, and as FIG. 7 demonstrates, at this stage of operation, the upper assembly can be utilized to grip and move the upper length of pipe in a direction unlocking or unscrewing the upper length of pipe from the lower length of pipe.

Figure 8:
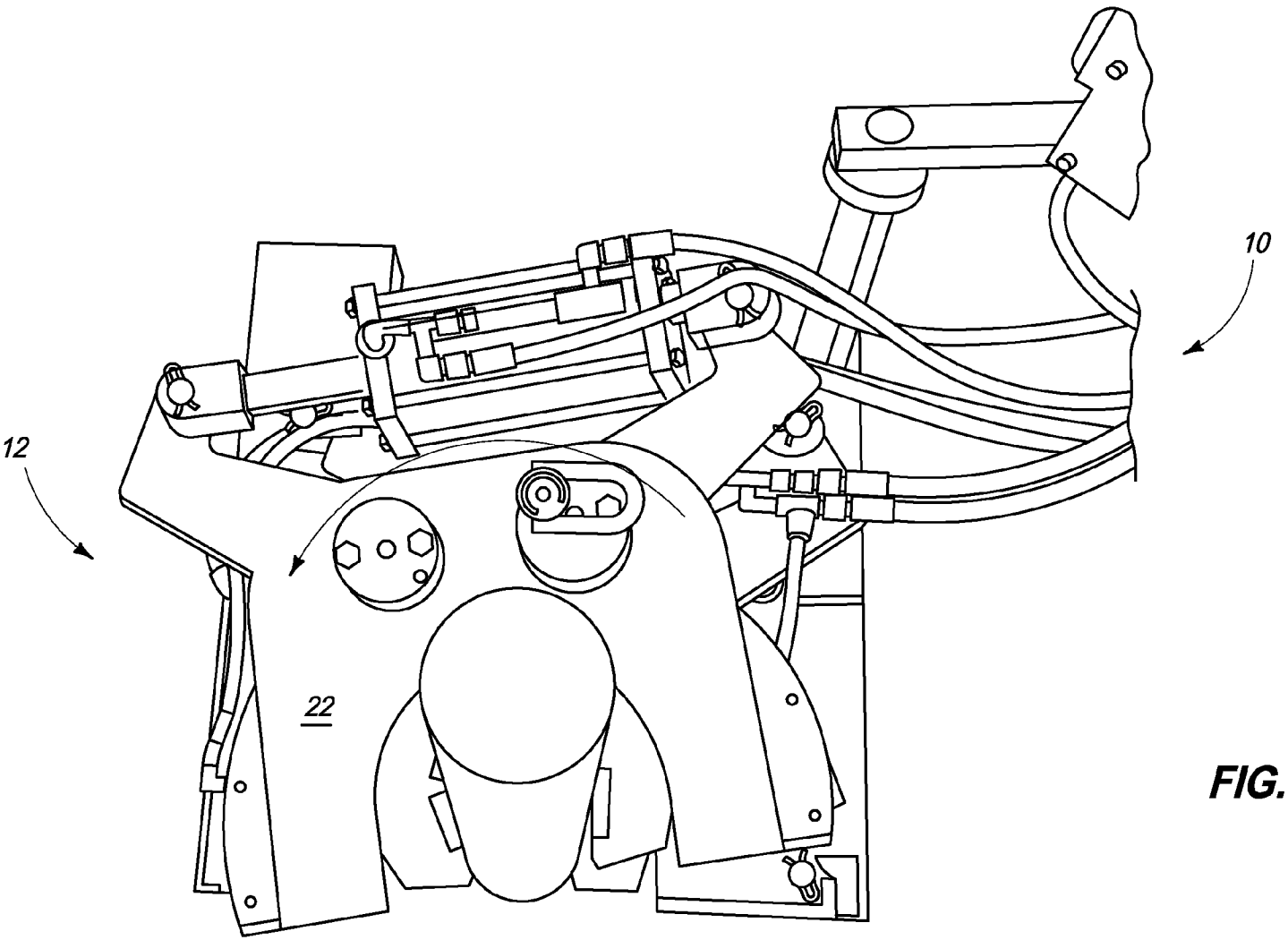
FIG. 8 is a top view of a breakout wrench at a stage of operation according to an embodiment.
Figure 9:
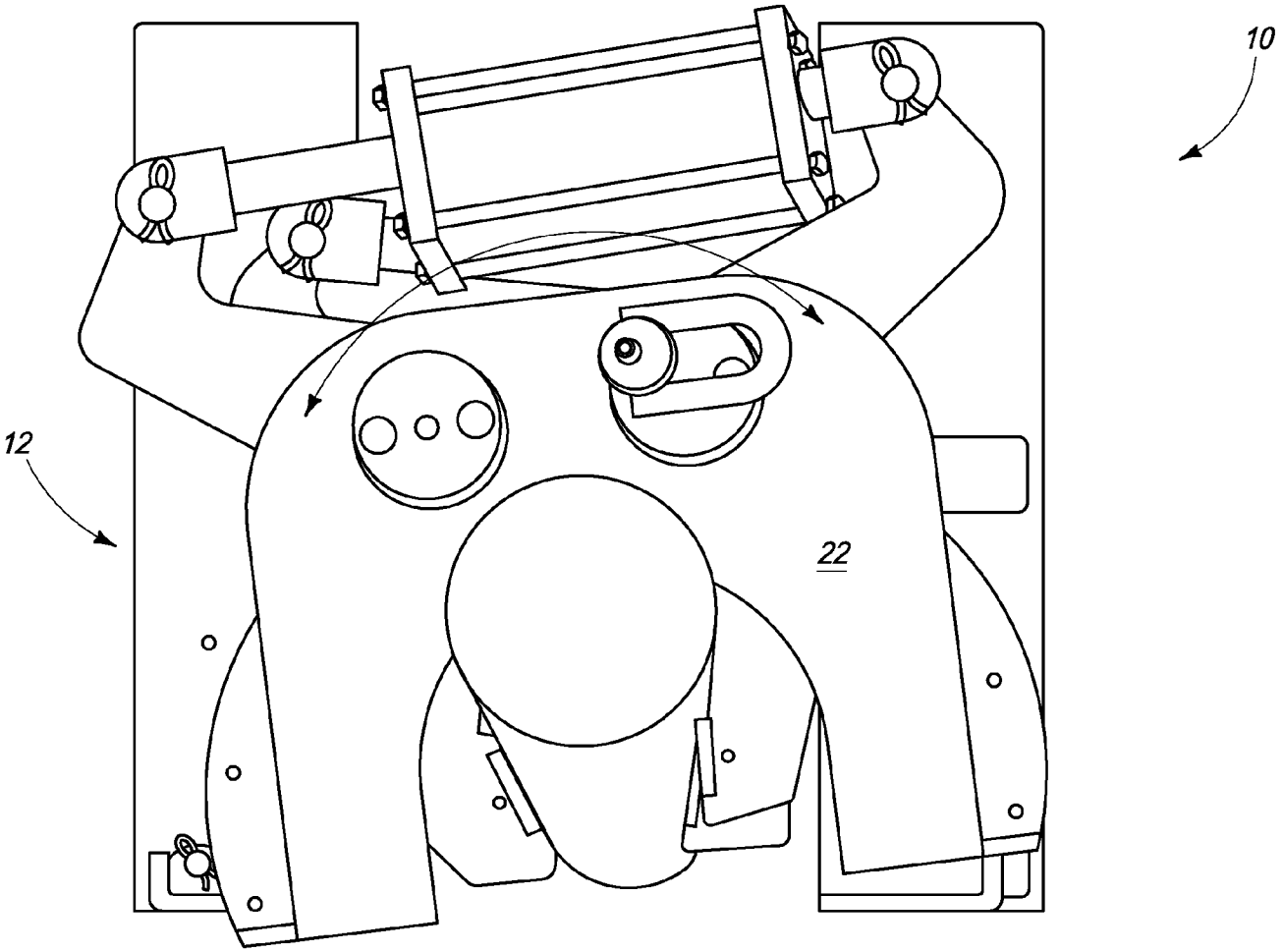
FIG. 9 is a breakout wrench at another stage of operation according to an embodiment.

Referring to FIG. 8, another view of the disclosure shows the upper sub assembly in an opposing or counterclockwise skew to the lower sub assembly and in FIG. 9, this is depicted as well.

Figure 10:
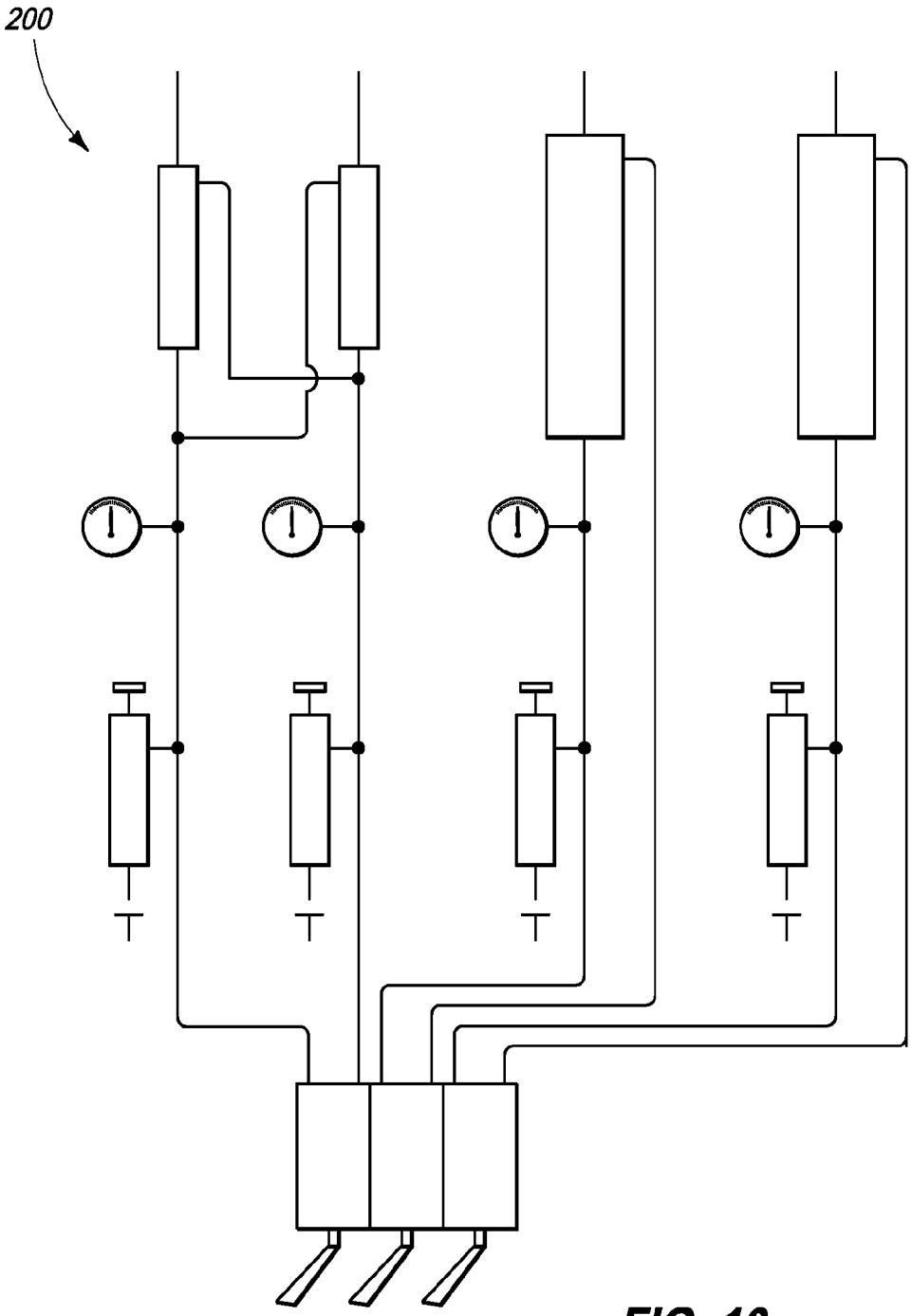
FIG. 10 is a hydraulic schematic of a controller as it relates to the breakout wrench of the present disclosure.

FIG. 10 demonstrates schematic 200 for the depicted control panel. Schematic 200 aligns the pressure regulation of various valves that control the upper wrench to rotate or upper assembly and lower assembly clamping force, respectively. Schematic 200 can include gauges that have respective control pressure valves residing therewith.

Figure 11:
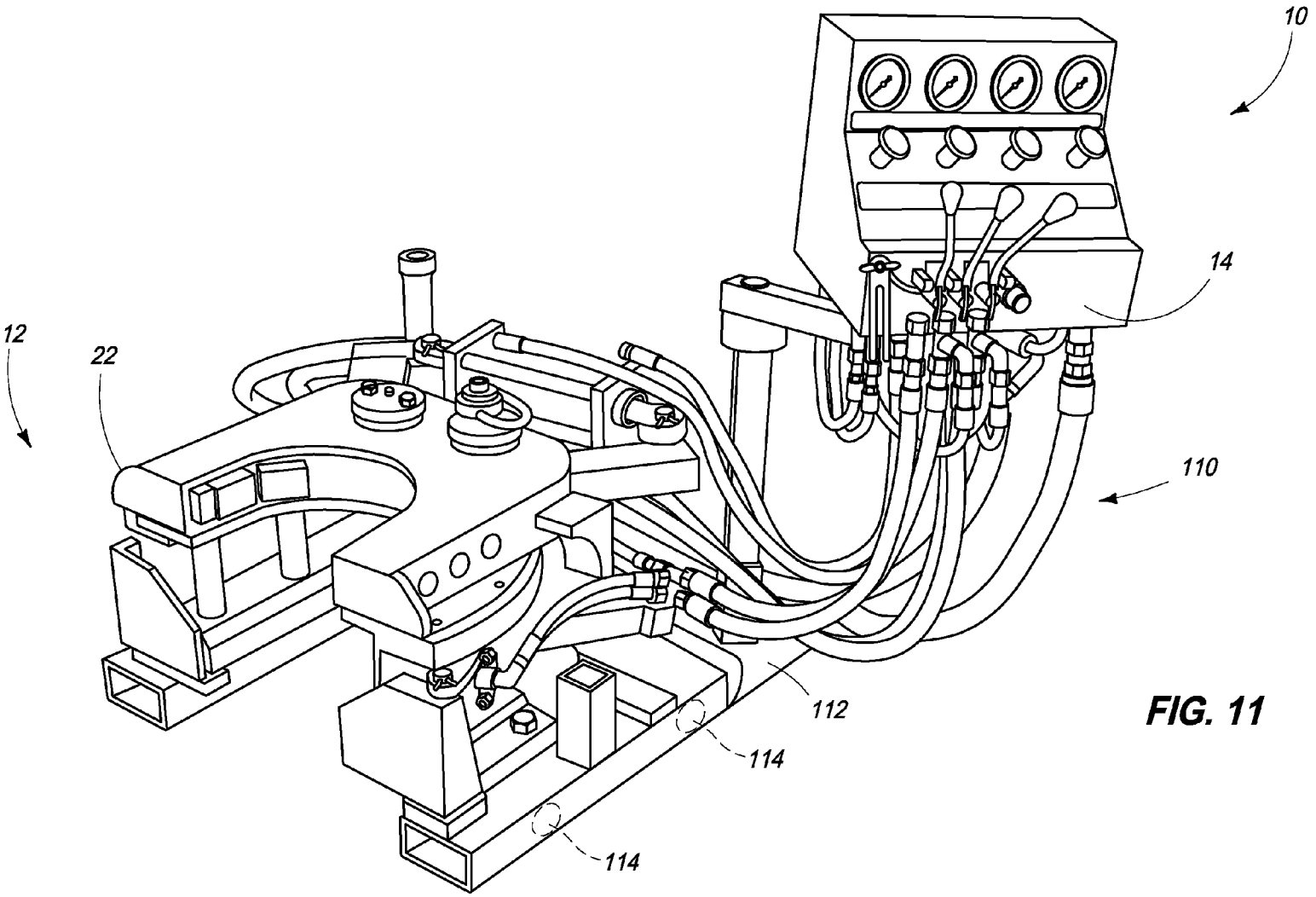
FIG. 11 is a depiction of the breakout wrench according to an embodiment.
Figures 12A, 12B, 12C, 12D:
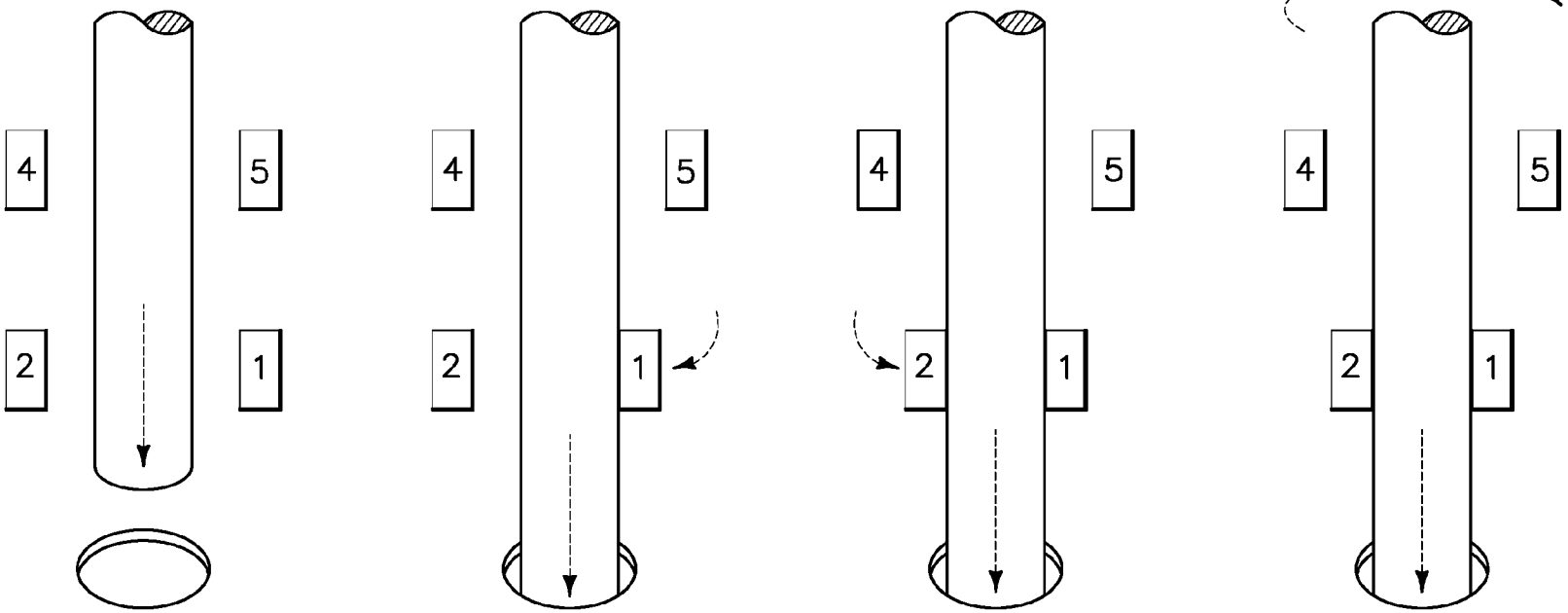
FIGS. 12A-12B depict a series of breakout wrench operations according to an embodiment.

FIG. 11 is a depiction of the completed sub assembly, and FIGS. 12A-12H depict a series of rotations 3 and 6 indicating the use of the arms and the rotation of the pipes associated therewith, with arms 4 and 5 indicating the upper arms of the upper sub assembly and arms 1 and 2 indicating the lower arms of the lower sub assembly. Controller 14 and wrench assemblies 12 and 18 can be supported and/or mechanically connected via platform 112. Controller 14 can provide hydraulic fluid control of actuators via lines 110. Platform 112 may be coupled to one or more wheels 114 configured to engage support and movement of the breakout wrench between operational and non-operational locations. As is depicted, this series indicates the different stages that the wrench utilizes to break apart the pipe sections.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A break out wrench assembly comprising:

a first subassembly, the first subassembly comprising a first pair of opposing arms linked by a first actuator configured to extend or compress a distance between the first pair of opposing arms;

a second subassembly aligned with the first subassembly to receive a longitudinal member therebetween and rotate axially along the longitudinal member in relation to the first subassembly, the second subassembly comprising a second pair of opposing arms linked by a second actuator configured to extend or compress another distance between the second pair of opposing arms;

at least one axial actuator coupled to the second subassembly and configured to rotate the second subassembly axially in relation to the first subassembly along the longitudinal member;

wherein the first subassembly is mechanically coupled to the second subassembly via an arcuate track defining a platform having a surface extending between opposing edges with the outermost edge horizontally engaging a closed ended recess, the track and closed ended recess confining the vertical relationship of the first and second subassemblies, wherein the platform is coupled to and supported by the first subassembly via a plurality of posts, the posts separating the platform from the first assembly; and a controller coupled to the actuators and mechanically coupled to at least one of the subassemblies.

2. The break out wrench assembly of claim 1 wherein one or more of the actuators are hydraulic cylinders, the hydraulic cylinders being in fluid communication with the controller.

3. The break out wrench assembly of claim 1 wherein the closed ended recess is defined by an upper plate and lower plate separated by a spacer.

* * * * *